US005575410A

United States Patent [19]

Compton

[11] Patent Number: 5,575,410

[45] Date of Patent: Nov. 19, 1996

[54] COLLAR AND CUFF PROTECTING DEVICE

[76] Inventor: Rose A. Compton, 878 Dennison Ave., Columbus, Ohio 43215

[21] Appl. No.: 533,695

[22] Filed: Sep. 26, 1995

[51] Int. Cl.[6] ..... A47G 25/00; B65D 85/18

[52] U.S. Cl. ..... 223/84; 223/81; 223/83; 206/297

[58] Field of Search ..... 223/81, 82, 83, 223/84, 87; 2/60, 129, 123; 206/292, 296, 297, 293

[56] References Cited

U.S. PATENT DOCUMENTS

| | | | |
|---|---|---|---|
| 454,201 | 6/1891 | Bowyer | 2/60 |
| 1,013,126 | 1/1912 | Cerri | 2/60 |
| 2,180,758 | 11/1939 | Honigsberg et al. | 2/60 |
| 2,221,673 | 11/1940 | Eiseman | 223/83 |
| 2,770,405 | 11/1956 | Williams | 223/83 |
| 3,088,117 | 5/1963 | Baker | 2/123 |
| 4,014,046 | 3/1977 | Craig | 2/60 |
| 5,388,734 | 2/1995 | Seitz . | |

FOREIGN PATENT DOCUMENTS

| | | | |
|---|---|---|---|
| 405771 | 2/1934 | United Kingdom | 223/84 |

OTHER PUBLICATIONS

0325711, European Patent Document, Aug. 1989, Peters.

*Primary Examiner*—Bibhu Mohanty

[57] ABSTRACT

A collar and cuff protecting device comprised of a protective collar portion fabricated of a pliable material. The protective collar has a central circular portion and a pair of end portions extending from opposing edges of the central circular portion whereby the pair of end portions are diametrically opposed from one another. The protective collar portion is adapted for securement underneath a shirt collar with the end portions extending around the shirt collar. Next is a protective cuff portion comprised of an open circular member. The protective cuff portion is adapted for securement within a cuff of a shirt.

1 Claim, 3 Drawing Sheets

COLLAR AND CUFF PROTECTING DEVICE

BACKGROUND OF THE INVENTION

1. Field of the Invention

The present invention relates to a collar and cuff protecting device and more particularly pertains to protecting collars and cuffs from becoming wrinkled and smashed with a collar and cuff protecting device.

2. Description of the Prior Art

The use of collar and cuff protectors is known in the prior art. More specifically, collar and cuff protectors heretofore devised and utilized for the purpose of protecting collars and cuffs are known to consist basically of familiar, expected and obvious structural configurations, notwithstanding the myriad of designs encompassed by the crowded prior art which have been developed for the fulfillment of countless objectives and requirements.

By way of example, U.S. Pat. No. 4,977,625 to Charters, III discloses an under-cuff protective device.

U.S. Pat. No. 4,953,232 to Gaines et al. discloses a collar protector.

U.S. Pat. No. 4,014,046 to Craig discloses a disposable cuff protector.

U.S. Pat. No. 4,008,494 to Hicks discloses a garment collar protector.

U.S. Pat. No. 3,855,631 to Ettinger discloses a protective neck collar.

U.S. Pat. No. 324,766 to Bacchus discloses the ornamental design for a collar protector.

While these devices fulfill their respective, particular objective and requirements, the aforementioned patents do not describe a collar and cuff protecting device for protecting collars and cuffs from becoming wrinkled and smashed.

In this respect, the collar and cuff protecting device according to the present invention substantially departs from the conventional concepts and designs of the prior art, and in doing so provides an apparatus primarily developed for the purpose of protecting collars and cuffs from becoming wrinkled and smashed.

Therefore, it can be appreciated that there exists a continuing need for new and improved collar and cuff protecting device which can be used for protecting collars and cuffs from becoming wrinkled and smashed. In this regard, the present invention substantially fulfills this need.

SUMMARY OF THE INVENTION

In the view of the foregoing disadvantages inherent in the known types of collar and cuff protectors now present in the prior art, the present invention provides an improved collar and cuff protecting device. As such, the general purpose of the present invention, which will be described subsequently in greater detail, is to provide a new and improved collar and cuff protecting device and method which has all the advantages of the prior art and none of the disadvantages.

To attain this, the present invention essentially comprises a protective collar portion fabricated of a pliable material. The protective collar has a central circular portion and a pair of end portions extending from opposing edges of the central circular portion whereby the pair of end portions are diametrically opposed from one another. Each of the end portions has a first end, a second end, and an intermediate extent therebetween. Each first end is integral with the central circular portion. Each second end has a width about twice the width of each first end with the width of the intermediate extent gradually decreasing from the second end to the first end. The first end has a width equal to the width of the central circular portion. The protective collar portion is adapted for securement underneath a shirt collar with the end portions extending around the shirt collar. The device includes a protective cuff portion comprised of an open circular member. The open circular member has a width equal to the width of the central circular portion of the protective collar portion. The protective cuff portion is adapted for securement within a cuff of a shirt.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved collar and cuff protecting device which has all the advantages of the prior art collar and cuff protectors and none of the disadvantages.

It is another object of the present invention to provide a new and improved collar and cuff protecting device which may be easily and efficiently manufactured and marketed.

It is a further object of the present invention to provide a new and improved collar and cuff protecting device which is of durable and reliable construction.

An even further object of the present invention is to provide a new and improved collar and cuff protecting device which is susceptible of a low cost of manufacture with regard to both materials and labor, and which accordingly is then susceptible of low prices of sale to the consuming public, thereby making such a collar and cuff protecting device economically available to the buying public.

Still yet another object of the present invention is to provide a new and improved collar and cuff protecting device which provides in the apparatuses and methods of the prior art some of the advantages thereof, while simultaneously overcoming some of the disadvantages normally associated therewith.

Even still another object of the present invention is to provide a new and improved collar and cuff protecting device for protecting collars and cuffs from becoming wrinkled and smashed.

Lastly, it is an object of the present invention to provide a new and improved collar and cuff protecting device comprised of a protective collar portion fabricated of a pliable material. The protective collar has a central circular portion and a pair of end portions extending from opposing edges of the central circular portion whereby the pair of end portions are diametrically opposed from one another. The protective collar portion is adapted for securement underneath a shirt collar with the end portions extending around the shirt collar. Next is a protective cuff portion comprised of an open circular member. The protective cuff portion is adapted for securement within a cuff of a shirt.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
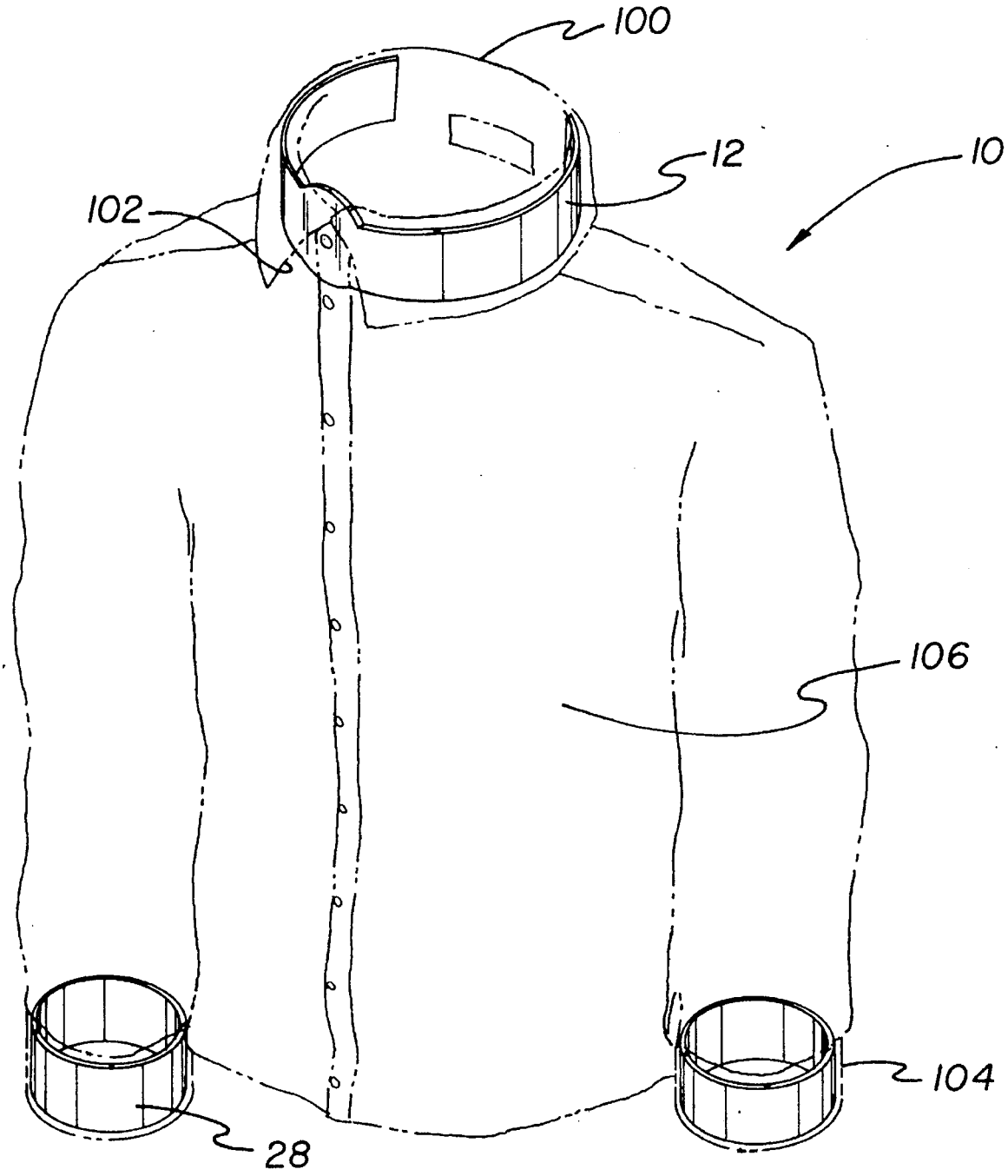
FIG. 1 is a perspective view of the preferred embodiment of the collar and cuff protecting device constructed in accordance with the principles of the present invention.
Figure 2:
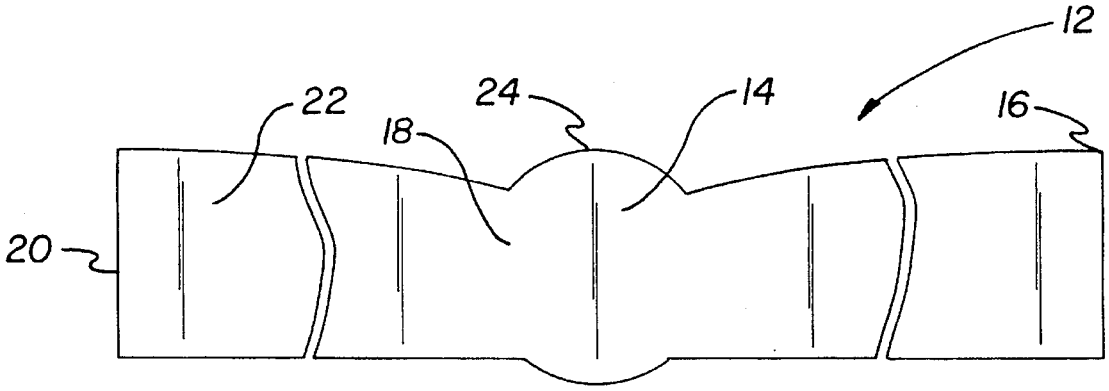
FIG. 2 is a plan view of the collar protector of the present invention.
Figure 3:
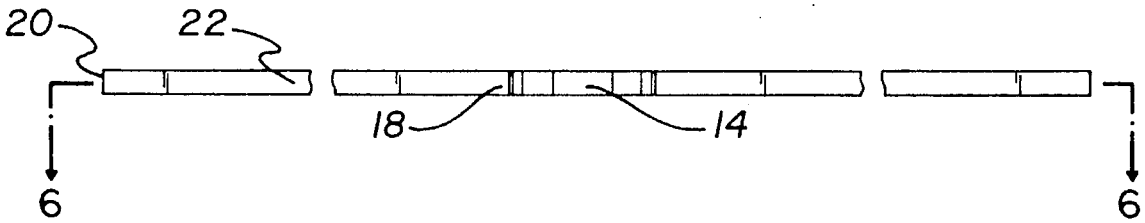
FIG. 3 is a side elevation view of the collar protector of the present invention.
Figure 4:
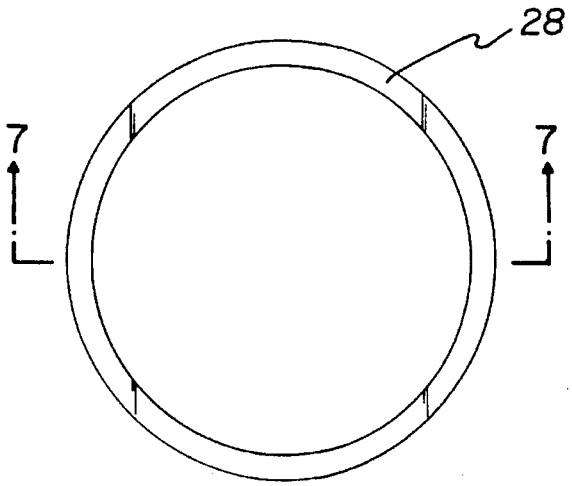
FIG. 4 is a plan view of the cuff protector of the present invention.
Figure 5:
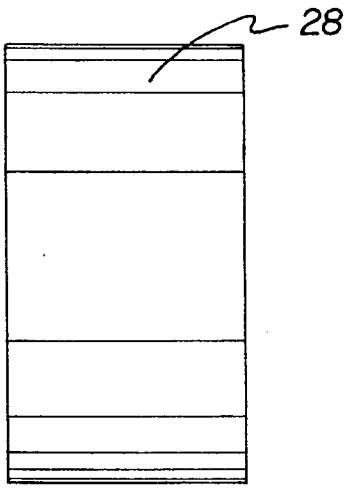
FIG. 5 is a side elevation view of the cuff protector of the present invention.
Figure 6:
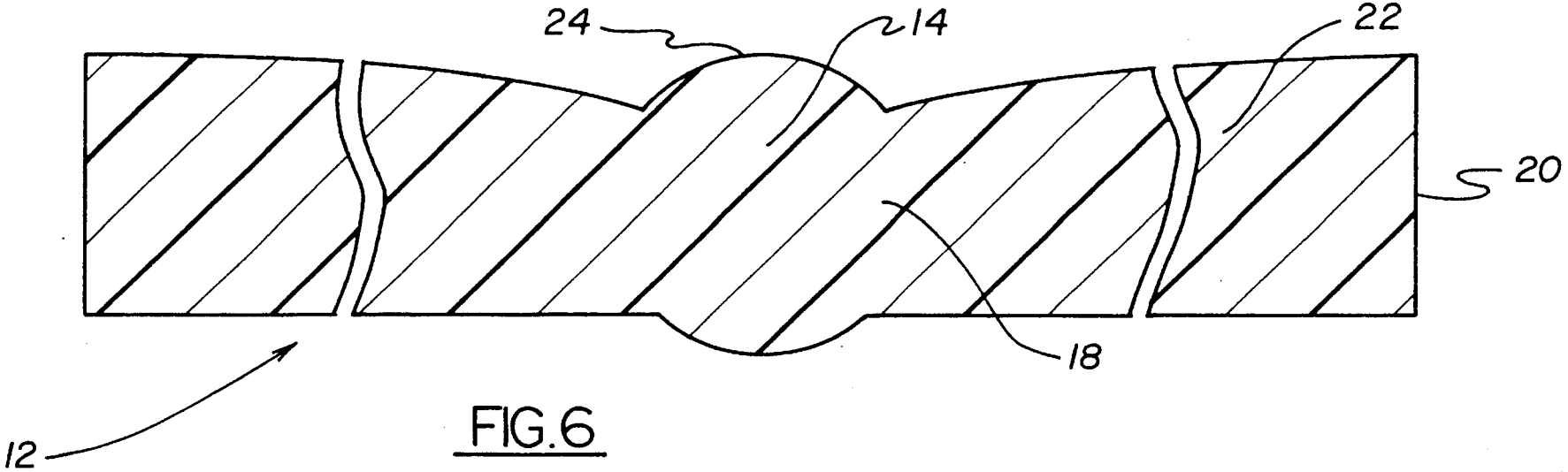
FIG. 6 is a cross-sectional view of the collar protector as taken along line 6—6 of FIG. 3.
Figure 7:
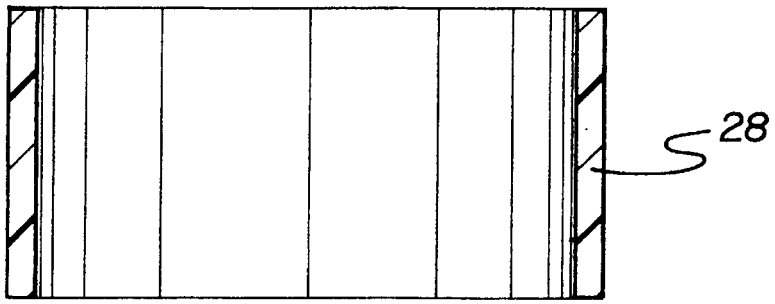
FIG. 7 is a cross-sectional view of the cuff protector as taken along line 7—7 of FIG. 4.

With reference now to the drawings, and in particular, to FIG. 1 thereof, the preferred embodiment of the new and improved collar and cuff protecting device embodying the principles and concepts of the present invention and generally designated by the reference number 10 will be described.

Specifically, it will be noted in the various Figures that the device relates to a new and improved collar and cuff protecting device for protecting collars and cuffs from becoming wrinkled and smashed. In its broadest context, the device consists of a protective collar portion and a protective cuff portion. Such components are individually configured and correlated with respect to each other so as to attain the desired objective.

The device 10 includes a protective collar portion 12 fabricated of a pliable material. The protective collar 12 has a central circular portion 14 and a pair of end portions 16 extending from opposing edges of the central circular portion 14 whereby the pair of end portions 16 are diametrically opposed from one another. Each of the end portions 16 has a first end 18, a second end 20, and an intermediate extent 22 therebetween. Each first end 18 is integral with the central circular portion 14. Each second end 20 has a width about twice the width of each first end 18 with the width of the intermediate extent 22 gradually decreasing from the second end 20 to the first end 18. The second end 20 has a width equal to the width of the central circular portion 14. The protective collar portion 12 is adapted for securement underneath a shirt collar 100 with the end portions 16 extending around the shirt collar 100. When in position under the shirt collar 100, an upper edge 24 of the central circular portion 14 is positioned under end portions 102 of the collar 100 thereby preventing the end portions 102 from losing their pressed and rigid form after the shirt has been pressed. Each end portion 16 is preferably three inches in length, with the first end 18 having a width of ⅞ of an inch and the second end 20 having a width of 1⅜ inches. The diameter of the central circular portion 14 is 1⅜ inches equal to the width of the second end 20 of the end portions 16.

The device 10 also includes a protective cuff portion 28 comprised of an open-circular member. The open circular member has a width equal to the width of the central circular portion 14 of the protective collar portion 12. The protective cuff portion 28 is adapted for securement within a cuff 104 of a shirt 106. The diameter of the protective cuff member 28 is 1⅜ inches, equal to the diameter of the central circular portion 14 of the protective collar portion 12.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. A collar and cuff protecting device for protecting collars and cuffs from becoming wrinkled and smashed comprising, in combination:

a protective collar portion fabricated of a pliable material, the protective collar having a central circular portion and a pair of end portions extending from opposing edges of the central circular portion whereby the pair of end portions being diametrically opposed from one another, each of the end portions having a first end, a second end, and an intermediate extent therebetween, each first end being integral with the central circular portion, each second end having a width about twice the width of each first end with the width of the intermediate extent gradually decreasing from the second end to the first end, the second end having a width equal to the width of the central circular portion, the protective collar portion adapted for securement underneath a shirt collar with the end portions extending around the shirt collar;

a protective cuff portion comprised of a continuous rigid open circular member without seams, the open circular member having a width equal to the width of the central circular portion of the protective collar portion, the protective cuff portion adapted for securement within a cuff of a shirt.

* * * * *